US010584709B2

(12) United States Patent
Peer et al.

(10) Patent No.: US 10,584,709 B2
(45) Date of Patent: Mar. 10, 2020

(54) ELECTRICALLY HEATED BALANCE PISTON SEAL

(71) Applicants: David J. Peer, Olean, NY (US); Paul Morrison Brown, Seattle, WA (US); Richard J. Wiederien, Bellevue, WA (US); Kirk Ryan Lupkes, Renton, WA (US); Brian David Massey, Seattle, WA (US); James M. Sorokes, Olean, NY (US); Mark J. Kuzdzal, Allegany, NY (US)

(72) Inventors: David J. Peer, Olean, NY (US); Paul Morrison Brown, Seattle, WA (US); Richard J. Wiederien, Bellevue, WA (US); Kirk Ryan Lupkes, Renton, WA (US); Brian David Massey, Seattle, WA (US); James M. Sorokes, Olean, NY (US); Mark J. Kuzdzal, Allegany, NY (US)

(73) Assignee: DRESSER-RAND COMPANY, Olean, NY (US)

( * ) Notice: Subject to any disclaimer, the term of this patent is extended or adjusted under 35 U.S.C. 154(b) by 1029 days.

(21) Appl. No.: 15/072,723

(22) Filed: Mar. 17, 2016

(65) Prior Publication Data

US 2017/0022999 A1 Jan. 26, 2017

Related U.S. Application Data

(60) Provisional application No. 62/139,039, filed on Mar. 27, 2015.

(51) Int. Cl.
*F04D 29/051* (2006.01)
*F04D 29/42* (2006.01)
(Continued)

(52) U.S. Cl.
CPC ..... *F04D 29/0516* (2013.01); *F04D 29/083* (2013.01); *F04D 29/4206* (2013.01);
(Continued)

(58) Field of Classification Search
CPC .. F04D 29/0516; F04D 29/162; F04D 29/582; F04D 29/584; F04D 29/4206;
(Continued)

(56) References Cited

U.S. PATENT DOCUMENTS 3,824,029 A * 7/1974 Fabri ..... F04D 29/288 415/109
4,060,337 A * 11/1977 Bell, III ..... F04D 29/284 416/186 R
(Continued)

*Primary Examiner* — Dwayne J White
*Assistant Examiner* — Danielle M. Christensen

(57) ABSTRACT

A balance piston seal assembly for a balance piston of a compressor is provided. The balance piston seal assembly may include a balance piston seal configured to be disposed about the balance piston such that an inner radial surface of the balance piston seal and an outer radial surface of the balance piston define a radial clearance therebetween. The balance piston seal assembly may also include a plurality of heaters in thermal communication with the balance piston seal and configured to heat and thermally expand the balance piston seal and thereby increase a radial length of the radial clearance.

15 Claims, 4 Drawing Sheets

(51) Int. Cl.
*F04D 29/08* (2006.01)
*F04D 29/58* (2006.01)
*F04D 29/28* (2006.01)

(52) U.S. Cl.
CPC ..... *F04D 29/584* (2013.01); *F04D 29/284* (2013.01); *F05D 2300/5021* (2013.01)

(58) Field of Classification Search
CPC ..... F04D 29/083; F04D 29/284; F05D 2300/5021; F05D 2240/55; F05B 2240/57; F16J 15/00; F16J 15/44; F16J 15/447; F16J 15/453
USPC ..... 415/174.1, 173.2
See application file for complete search history.

(56) References Cited

U.S. PATENT DOCUMENTS 5,217,232 A * 6/1993 Makhobey ..... F16J 15/164 277/411
5,667,358 A * 9/1997 Gaul ..... F01D 11/24 415/173.1
6,220,814 B1 * 4/2001 Brushwood ..... F01D 11/001 219/201
2012/0183388 A1 * 7/2012 Vannini ..... F04D 29/122 415/111
2015/0044018 A1 * 2/2015 Dierksmeier ..... F01D 11/001 415/1
2016/0186611 A1 * 6/2016 Vetters ..... F01D 25/246 415/173.2

* cited by examiner

ELECTRICALLY HEATED BALANCE PISTON SEAL

This application claims the benefit of U.S. Provisional Patent Application having Ser. No. 62/139,039, which was filed Mar. 27, 2016. The aforementioned patent application is hereby incorporated by reference in its entirety into the present application to the extent consistent with the present application.

STATEMENT OF GOVERNMENT INTEREST

This invention was made with government support under Government Contract No. DOE-DE-FE0000493 awarded by the U.S. Department of Energy. The government has certain rights in the invention.

BACKGROUND

Compressors and systems incorporating compressors have been developed and are often utilized in a myriad of industrial processes (e.g., petroleum refineries, offshore oil production platforms, and subsea process control systems). Conventional compressors may be configured to compress a process fluid by applying kinetic energy to the process fluid to transport the process fluid from a low pressure environment to a high pressure environment. The compressed process fluid discharged from the compressors may be utilized to efficiently perform work or operate one or more downstream processes. Improvements in the efficiency of conventional compressors has increased the application of the compressors at various oil production sites. Many of the oil production sites (e.g., offshore), however, may be constrained or limited in space. Accordingly, there is an increased interest and demand for smaller and lighter compressors, or compact compressors. In addition to the foregoing, it is often desirable that the compact compressors be capable of achieving higher compression ratios (e.g., 10:1 or greater) for increased production while maintaining a compact footprint.

To achieve the higher compression ratios, conventional compact compressors may often utilize an impeller and a balance piston integrally formed with the impeller. The impeller may be configured to rotate within the compact compressors to accelerate the process fluid, and the integral balance piston may be configured to balance axial thrusts generated by the rotation of the impeller. As the impeller rotates to accelerate the process fluid, however, at least a portion of the process fluid may leak or flow pass the impeller and the balance piston (e.g., via radial clearances), thereby reducing the efficiency of the compact compressors.

In view of the foregoing, conventional compact compressors may often utilize balance piston seals (e.g., hole pattern seals) to manage the leakage flow of the process fluid. However, as the impeller accelerates to the rotational speeds necessary to achieve the higher compression ratios (e.g., 10:1 or greater), thermal energy (e.g., heat of compression) and/or centrifugal forces may cause the impeller and the balance piston to expand or grow at a relatively increased rate relative to the stationary balance piston seal. The relatively increased rate of expansion exhibited by the impeller and the balance piston integrally formed therewith may often result in decreased operational efficiencies, and may ultimately result in damage to the compact compressors and/or components thereof. For example, radial and/or axial growth of the impeller and the balance piston may correspondingly decrease or eliminate clearances (e.g., radial clearances) between the balance piston and the balance piston seal, thereby resulting in damage from the incidental contact between the balance piston and the balance piston seal.

What is needed, then, is an improved balance piston seal assembly for a compact compressor having relatively high compression ratios.

SUMMARY

Embodiments of the disclosure may provide a balance piston seal assembly for a balance piston of a compressor. The balance piston seal assembly may include a balance piston seal configured to be disposed about the balance piston such that an inner radial surface of the balance piston seal and an outer radial surface of the balance piston define a radial clearance therebetween. The balance piston seal assembly may also include a plurality of heaters in thermal communication with the balance piston seal and configured to heat and thermally expand the balance piston seal and thereby increase a radial length of the radial clearance.

Embodiments of the disclosure may also provide a compressor including a casing, a rotary shaft disposed in the casing and configured to be driven by a driver, and an impeller coupled with and configured to be driven by the rotary shaft. The compressor may also include a balance piston integral with the impeller and configured to balance an axial thrust generated by the impeller. The compressor may further include a balance piston seal disposed about the balance piston, and a plurality of heaters in thermal communication with the balance piston seal. The balance piston seal may be disposed about the balance piston such that an inner radial surface of the balance piston seal and an outer radial surface of the balance piston define a radial clearance therebetween. The plurality of heaters may be configured to heat and thermally expand the balance piston seal and thereby increase a radial length of the radial clearance.

Embodiments of the disclosure may further provide a compression system. The compression system may include a driver and a compressor coupled with and configured to be driven by the driver. The compressor may include a casing, an inlet, a rotary shaft, and an impeller. The inlet may be coupled or integral with the casing. The inlet and the casing may at least partially define a fluid pathway of the compressor configured to receive a process fluid. The rotary shaft may be disposed in the casing and configured to couple the compressor with the driver. The impeller may be coupled with and configured to be rotated by the driver via the rotary shaft. The compressor may also include a balance piston integral with the impeller and configured to balance an axial thrust generated by the rotation of the impeller. A balance piston seal may be disposed radially outward of the balance piston such that the balance piston seal and the balance piston define a radial clearance therebetween. A plurality of heaters may be in thermal communication with the balance piston seal and configured to heat and thermally expand the balance piston seal and thereby increase a radial length of the radial clearance.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
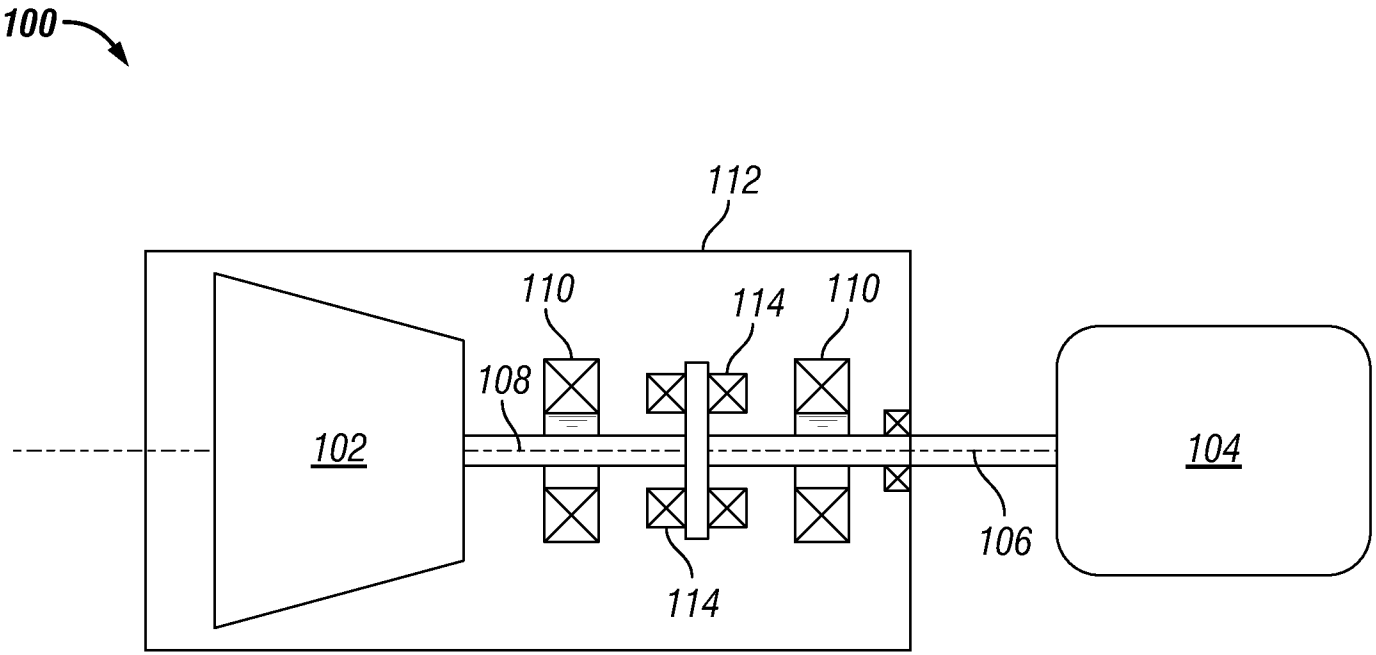
FIG. 1 illustrates a schematic view of an exemplary compression system including a compressor, according to one or more embodiments disclosed.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates a schematic view of an exemplary compression system 100, according to one or more embodiments. The compression system 100 may include, amongst other components, one or more compressors 102 (one is shown), a driver 104, and a drive shaft 106 configured to operatively couple the compressor 102 with the driver 104. The compression system 100 may be configured to compress or pressurize a process fluid. For example, as further described herein, the driver 104 may be configured to drive the compressor 102 via the drive shaft 106 to compress the process fluid. In an exemplary embodiment, the compression system 100 may have a compression ratio of at least about 6:1 or greater. For example, the compression system 100 may compress the process fluid to a compression ratio of about 6:1, about 6.1:1, about 6.2:1, about 6.3:1, about 6.4:1, about 6.5:1, about 6.6:1, about 6.7:1, about 6.8:1, about 6.9:1, about 7:1, about 7.1:1, about 7.2:1, about 7.3:1, about 7.4:1, about 7.5:1, about 7.6:1, about 7.7:1, about 7.8:1, about 7.9:1, about 8:1, about 8.1:1, about 8.2:1, about 8.3:1, about 8.4:1, about 8.5:1, about 8.6:1, about 8.7:1, about 8.8:1, about 8.9:1, about 9:1, about 9.1:1, about 9.2:1, about 9.3:1, about 9.4:1, about 9.5:1, about 9.6:1, about 9.7:1, about 9.8:1, about 9.9:1, about 10:1, about 10.1:1, about 10.2:1, about 10.3:1, about 10.4:1, about 10.5:1, about 10.6:1, about 10.7:1, about 10.8:1, about 10.9:1, about 11:1, about 11.1:1, about 11.2:1, about 11.3:1, about 11.4:1, about 11.5:1, about 11.6:1, about 11.7:1, about 11.8:1, about 11.9:1, about 12:1, about 12.1:1, about 12.2:1, about 12.3:1, about 12.4:1, about 12.5:1, about 12.6:1, about 12.7:1, about 12.8:1, about 12.9:1, about 13:1, about 13.1:1, about 13.2:1, about 13.3:1, about 13.4:1, about 13.5:1, about 13.6:1, about 13.7:1, about 13.8:1, about 13.9:1, about 14:1, or greater.

The compressor 102 may be a direct-inlet centrifugal compressor. The direct-inlet centrifugal compressor may be, for example, a version of a Dresser-Rand Pipeline Direct Inlet (PDI) centrifugal compressor manufactured by the Dresser-Rand Company of Olean, N.Y. The compressor 102 may have a center-hung rotor configuration or an overhung rotor configuration, as illustrated in FIG. 1. In an exemplary embodiment, the compressor 102 may be an axial-inlet centrifugal compressor. In another embodiment, the compressor 102 may be a radial-inlet centrifugal compressor. As previously discussed, the compression system 100 may include one or more compressors 102. For example, the compression system 100 may include a plurality of compressors (not shown). In another example, illustrated in FIG. 1, the compression system 100 may include a single compressor 102. The compressor 102 may be a supersonic compressor or a subsonic compressor. In at least one embodiment, the compression system 100 may include a plurality of compressors (not shown), and at least one compressor of the plurality of compressors is a subsonic compressor. In another embodiment, illustrated in FIG. 1, the compression system 100 includes a single compressor 102, and the single compressor 102 is a supersonic compressor.

The compressor 102 may include one or more stages (not shown). In at least one embodiment, the compressor 102 may be a single-stage compressor. In another embodiment, the compressor 102 may be a multi-stage centrifugal compressor. Each stage (not shown) of the compressor 102 may be a subsonic compressor stage or a supersonic compressor stage. In an exemplary embodiment, the compressor 102 may include a single supersonic compressor stage. In another embodiment, the compressor 102 may include a plurality of subsonic compressor stages. In yet another embodiment, the compressor 102 may include a subsonic compressor stage and a supersonic compressor stage. Any one or more stages of the compressor 102 may have a compression ratio greater than about 1:1. For example, any one or more stages of the compressor 102 may have a compression ratio of about 1.1:1, about 1.2:1, about 1.3:1, about 1.4:1, about 1.5:1, about 1.6:1, about 1.7:1, about 1.8:1, about 1.9:1, about 2:1, about 2.1:1, about 2.2:1, about 2.3:1, about 2.4:1, about 2.5:1, about 2.6:1, about 2.7:1, about 2.8:1, about 2.9:1, about 3:1, about 3.1:1, about 3.2:1, about 3.3:1, about 3.4:1, about 3.5:1, about 3.6:1, about 3.7:1, about 3.8:1, about 3.9:1, about 4:1, about 4.1:1, about 4.2:1, about 4.3:1, about 4.4:1, about 4.5:1, about 4.6:1, about 4.7:1, about 4.8:1, about 4.9:1, about 5:1, about 5.1:1, about 5.2:1, about 5.3:1, about 5.4:1, about 5.5:1, about 5.6:1, about 5.7:1, about 5.8:1, about 5.9:1, about 6:1, about 6.1:1, about 6.2:1, about 6.3:1, about 6.4:1, about 6.5:1, about 6.6:1, about 6.7:1, about 6.8:1, about 6.9:1, about 7:1, about 7.1:1, about 7.2:1, about 7.3:1, about 7.4:1, about 7.5:1, about 7.6:1, about 7.7:1, about 7.8:1, about 7.9:1, about 8.0:1, about 8.1:1, about 8.2:1, about 8.3:1, about 8.4:1, about 8.5:1, about 8.6:1, about 8.7:1, about 8.8:1, about 8.9:1, about 9:1, about 9.1:1, about 9.2:1, about 9.3:1, about 9.4:1, about 9.5:1, about 9.6:1, about 9.7:1, about 9.8:1, about 9.9:1, about 10:1, about 10.1:1, about 10.2:1, about 10.3:1, about 10.4:1, about 10.5:1, about 10.6:1, about 10.7:1, about 10.8:1, about 10.9:1, about 11:1, about 11.1:1, about 11.2:1, about 11.3:1, about 11.4:1, about 11.5:1, 11 3.6:1, about 11.7:1, about 11.8:1, about 11.9:1, about 12:1, about 12.1:1, about 12.2:1, about 12.3:1, about 12.4:1, about 12.5:1, about 12.6:1, about 12.7:1, about 12.8:1, about 12.9:1, about 13:1, about 13.1:1, about 13.2:1, about 13.3:1, about 13.4:1, about 13.5:1, about 13.6:1, about 13.7:1, about 13.8:1, about 13.9:1, about 14:1, or greater. In an exemplary embodiment, the compressor 102 may include a plurality of compressor stages, where a first stage (not shown) of the plurality of compressor stages may have a compression ratio of about 1.75:1 and a second stage (not shown) of the plurality of compressor stages may have a compression ratio of about 6.0:1.

The driver 104 may be configured to provide the drive shaft 106 with rotational energy. The drive shaft 106 may be integral or coupled with a rotary shaft 108 of the compressor 102 such that the rotational energy of the drive shaft 106 may be transmitted to the rotary shaft 108. The drive shaft 106 of the driver 104 may be coupled with the rotary shaft 108 via a gearbox (not shown) having a plurality of gears configured to transmit the rotational energy of the drive shaft 106 to the rotary shaft 108 of the compressor 102. Accordingly, the drive shaft 106 and the rotary shaft 108 may spin at the same speed, substantially similar speeds, or differing speeds and rotational directions via the gearbox. The driver 104 may be a motor, such as a permanent magnetic electric motor, and may include a stator (not shown) and a rotor (not shown). It should be appreciated, however, that other embodiments may employ other types of motors including, but not limited to, synchronous motors, induction motors, and brushed DC motors, or the like. The driver 104 may also be a hydraulic motor, an internal combustion engine, a steam turbine, a gas turbine, or any other device capable of driving or rotating the rotary shaft 108 of the compressor 102.

The compression system 100 may include one or more radial bearings 110 directly or indirectly supported by a housing 112 of the compression system 100. The radial bearings 110 may be configured to support the drive shaft 106 and/or the rotary shaft 108. The radial bearings 110 may be oil film bearings. The radial bearings 110 may also be magnetic bearings, such as active magnetic bearings, passive magnetic bearings, or the like. The compression system 100 may also include one or more axial thrust bearings 114 disposed adjacent the rotary shaft 108 and configured to control the axial movement of the rotary shaft 108. The axial thrust bearings 114 may be magnetic bearings configured to at least partially support and/or counter thrust loads or forces generated by the compressor 102.

The process fluid pressurized, circulated, contained, or otherwise utilized in the compression system 100 may be a fluid in a liquid phase, a gas phase, a supercritical state, a subcritical state, or any combination thereof. The process fluid may be a mixture, or process fluid mixture. The process fluid may include one or more high molecular weight process fluids, one or more low molecular weight process fluids, or any mixture or combination thereof. As used herein, the term "high molecular weight process fluids" refers to process fluids having a molecular weight of about 30 grams per mole (g/mol) or greater. Illustrative high molecular weight process fluids may include, but are not limited to, hydrocarbons, such as ethane, propane, butanes, pentanes, and hexanes. Illustrative high molecular weight process fluids may also include, but are not limited to, carbon dioxide ($CO_2$) or process fluid mixtures containing carbon dioxide. As used herein, the term "low molecular weight process fluids" refers to process fluids having a molecular weight less than about 30 g/mol. Illustrative low molecular weight process fluids may include, but are not limited to, air, hydrogen, methane, or any combination or mixtures thereof.

In an exemplary embodiment, the process fluid or the process fluid mixture may be or include carbon dioxide. The amount of carbon dioxide in the process fluid or the process fluid mixture may be at least about 80%, at least about 85%, at least about 90%, at least about 95%, at least about 96%, at least about 97%, at least about 98%, at least about 99%, or greater by volume. Utilizing carbon dioxide as the process fluid or as a component or part of the process fluid mixture in the compression system 100 may provide one or more advantages. For example, carbon dioxide may provide a readily available, inexpensive, non-toxic, and non-flammable process fluid. In another example, the relatively high working pressure of applications utilizing carbon dioxide may allow the compression system 100 incorporating carbon dioxide (e.g., as the process fluid or as part of the process fluid mixture) to be relatively more compact than compression systems incorporating other process fluids (e.g., process fluids not including carbon dioxide). Additionally, the high density and high heat capacity or volumetric heat capacity of carbon dioxide with respect to other process fluids may make carbon dioxide more "energy dense." Accordingly, a relative size of the compression system 100 and/or the components thereof may be reduced without reducing the performance of the compression system 100.

The carbon dioxide may be of any particular type, source, purity, or grade. For example, industrial grade carbon dioxide may be utilized as the process fluid without departing from the scope of the disclosure. Further, as previously discussed, the process fluids may be a mixture, or process fluid mixture. The process fluid mixture may be selected for one or more desirable properties of the process fluid mixture within the compression system 100. For example, the process fluid mixture may include a mixture of a liquid absorbent and carbon dioxide (or a process fluid containing carbon dioxide) that may enable the process fluid mixture to be compressed to a relatively higher pressure with less energy input than compressing carbon dioxide (or a process fluid containing carbon dioxide) alone.

Figure 2A:
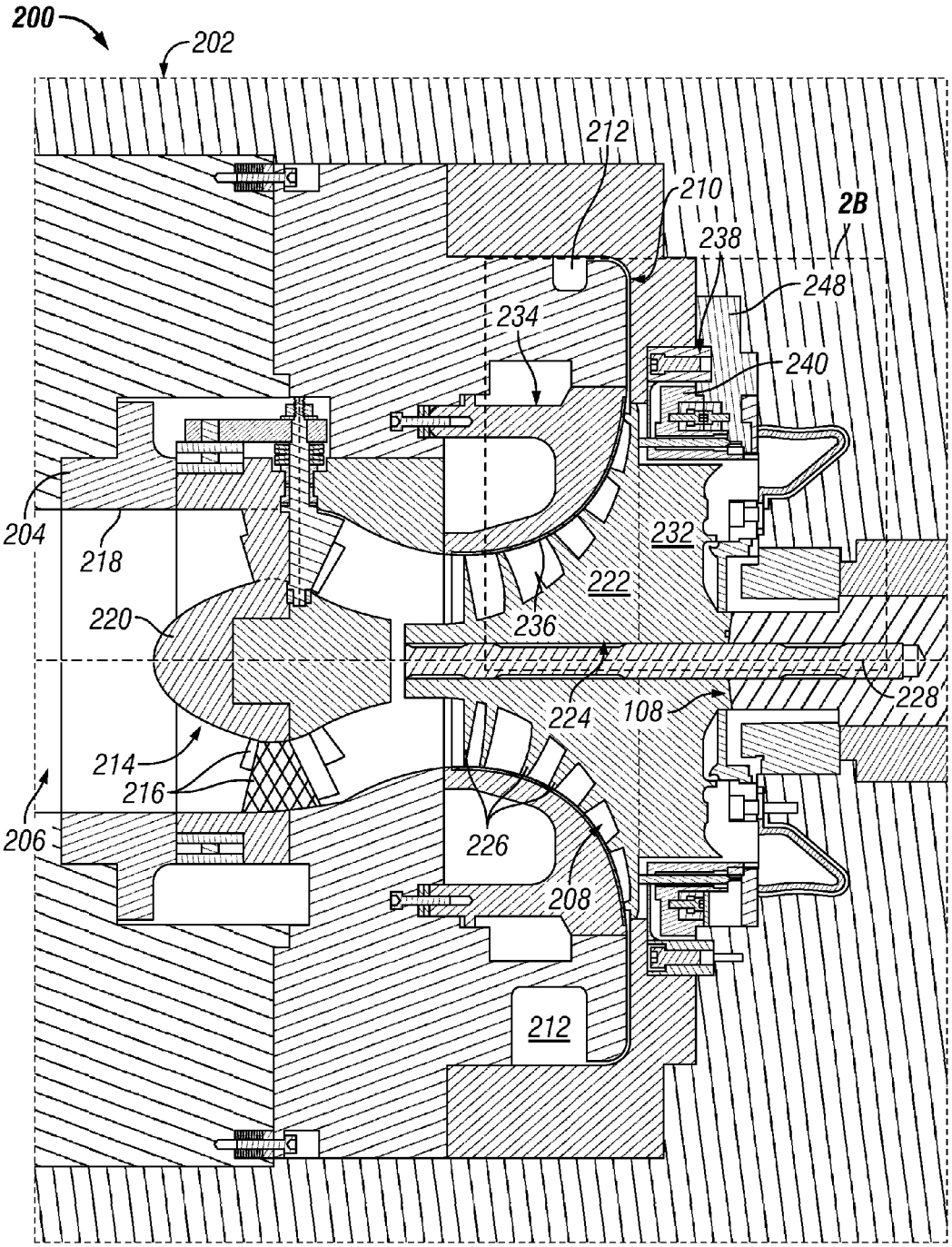
FIG. 2A illustrates a partial, cross-sectional view of an exemplary compressor that may be included in the compression system of FIG. 1, according to one or more embodiments disclosed.
Figure 2B:
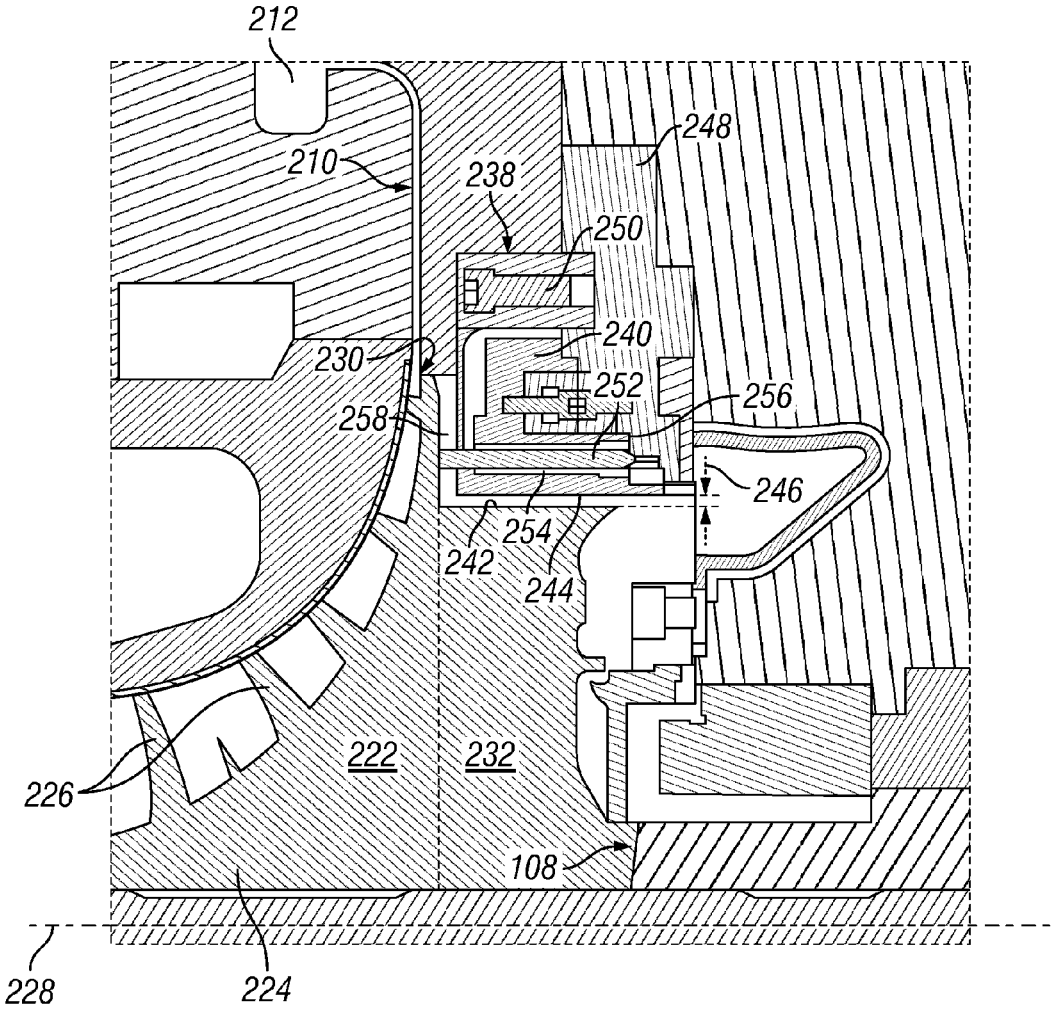
FIG. 2B illustrates an enlarged view of the portion of the compressor indicated by the box labeled 2B of FIG. 2A, according to one or more embodiments disclosed.

FIG. 2A illustrates a partial, cross-sectional view of an exemplary compressor 200 that may be included in the compression system 100 of FIG. 1, according to one or more embodiments. FIG. 2B illustrates an enlarged view of the portion of the compressor 200 indicated by the box labeled 2B of FIG. 2A, according to one or more embodiments. As illustrated in FIG. 2A, the compressor 200 may include a casing 202 and an inlet 204 (e.g., an axial inlet). The casing 202 and the inlet 204 may at least partially define a fluid pathway of the compressor 200 through which the process fluid may flow. The fluid pathway may include an inlet passageway 206 configured to receive the process fluid, an impeller cavity 208 fluidly coupled with the inlet passageway 206, a diffuser 210 (e.g., static diffuser) fluidly coupled with the impeller cavity 208, and a collector or volute 212 fluidly coupled with the diffuser 210. The casing 202 may be configured to support and/or protect one or more components of the compressor 200. The casing 202 may also be configured to contain the process fluid flowing through one or more portions or components of the compressor 200.

As illustrated in FIG. 2A, the compressor 200 may include an inlet guide vane assembly 214 configured to condition a process fluid flowing through the inlet passageway 206 to achieve predetermined or desired fluid properties and/or fluid flow attributes. Such fluid properties and/or fluid flow attributes may include flow pattern (e.g., swirl distribution), velocity, flow rate, pressure, temperature, and/or any suitable fluid property and fluid flow attribute to enable the compressor 200 to function as described herein. The inlet guide vane assembly 214 may include one or more inlet guide vanes 216 disposed in the inlet passageway 206 and configured to impart the one or more fluid properties and/or fluid flow attributes to the process fluid flowing through the inlet passageway 206. The inlet guide vanes 216 may also be configured to vary the one or more fluid properties and/or fluid flow attributes of the process fluid flowing through the inlet passageway 206. For example, respective portions of the inlet guide vanes 216 may be moveable (e.g., adjustable) to vary the one or more fluid properties and/or fluid flow attributes (e.g., swirl, velocity, mass flowrate, etc.) of the process fluid flowing through the inlet passageway 206. In an exemplary embodiment, the inlet guide vanes 216 may be configured to move or adjust within the inlet passageway 206, as disclosed in U.S. Pat. No. 8,632,302, the subject matter of which is incorporated by reference herein to the extent consistent with the present disclosure.

In another embodiment, illustrated in FIG. 2A, the inlet guide vanes 216 may extend through the inlet passageway 206 from an inner surface 218 of the inlet 204 to a hub 220 of the inlet guide vane assembly 214. The inlet guide vanes 216 may be circumferentially spaced at substantially equal intervals or at varying intervals about the hub 220. The inlet guide vanes 216 may be airfoil shaped, streamline shaped, or otherwise shaped and configured to at least partially impart the one or more fluid properties on the process fluid flowing through the inlet passageway 206.

The compressor 200 may include an impeller 222 disposed in the impeller cavity 208. The impeller 222 may have a hub 224 and a plurality of blades 226 extending from the hub 224. In an exemplary embodiment, illustrated in FIG. 2A, the impeller 222 may be an open or "unshrouded" impeller. In another embodiment, the impeller 222 may be a shrouded impeller. The impeller 222 may be configured to rotate about a longitudinal axis 228 of the compressor 200 to increase the static pressure and/or the velocity of the process fluid flowing therethrough. For example, the hub 224 of the impeller 222 may be coupled with the rotary shaft 108, and the impeller 222 may be driven or rotated by the driver 104 (see FIG. 1) via the rotary shaft 108 and the drive shaft 106. The rotation of the impeller 222 may draw the process fluid into the compressor 200 via the inlet passageway 206. The rotation of the impeller 222 may further draw the process fluid to and through the impeller 222 and accelerate the process fluid to a tip 230 (see FIG. 2B) of the impeller 222, thereby increasing the static pressure and/or the velocity of the process fluid. The plurality of blades 226 may be configured to impart the static pressure (potential energy) and/or the velocity (kinetic energy) to the process fluid to raise the velocity of the process fluid and direct the process fluid from the impeller 222 to the diffuser 210 fluidly coupled therewith. The diffuser 210 may be configured to convert kinetic energy of the process fluid from the impeller 222 into increased static pressure.

In one or more embodiments, the process fluid at the tip 230 of the impeller 222 may be subsonic and have an absolute Mach number less than one. For example, the process fluid at the tip 230 of the impeller 222 may have an absolute Mach number less than 1, less than 0.9, less than 0.8, less than 0.7, less than 0.6, less than 0.5, less than 0.4, less than 0.3, less than 0.2, or less than 0.1. Accordingly, in such embodiments, the compressors 102, 200 discussed herein may be "subsonic," as the impeller 222 may be configured to rotate about the longitudinal axis 228 at a speed sufficient to provide the process fluid at the tip 230 thereof with an absolute Mach number of less than one.

In one or more embodiments, the process fluid at the tip 230 of the impeller 222 may be supersonic and have an absolute Mach number of one or greater. For example, the process fluid at the tip 230 of the impeller 222 may have an absolute Mach number of at least 1, at least 1.1, at least 1.2, at least 1.3, at least 1.4, or at least 1.5. Accordingly, in such embodiments, the compressors 102, 200 discussed herein are said to be "supersonic," as the impeller 222 may be configured to rotate about the longitudinal axis 228 at a speed sufficient to provide the process fluid at the tip 230 thereof with an absolute Mach number of one or greater or with a fluid velocity greater than the speed of sound. In a supersonic compressor or a stage thereof, the rotational or tip speed of the impeller 222 may be about 500 meters per second (m/s) or greater. For example, the tip speed of the impeller 222 may be about 510 m/s, about 520 m/s, about 530 m/s, about 540 m/s, about 550 m/s, about 560 m/s, or greater.

As illustrated in FIGS. 2A and 2B, the compressor 200 may include a balance piston 232 configured to balance an axial thrust generated by the impeller 222 during one or more modes of operating the compressor 200. In at least one embodiment, the balance piston 232 and the impeller 222 may be separate components. For example, the balance piston 232 and the impeller 222 may be separate annular components coupled with one another. In another embodiment, illustrated in FIGS. 2A and 2B, the balance piston 232 may be integral with the impeller 222, such that the balance piston 232 and the impeller 222 may be formed from a single or unitary annular piece.

As illustrated in FIGS. 2A and 2B, the compressor 200 may also include a shroud 234 disposed proximal the impeller 222. For example, the shroud 234 may be disposed adjacent the plurality of blades 226 of the impeller 222. The shroud 234 may extend annularly about the impeller 222 such that an inner surface 236 thereof may be disposed near or proximal the plurality of blades 226 of the impeller 222. During one or more modes of operating the compressor 200, the inner surface 236 of the shroud 234 and the impeller 222 may define an impeller clearance (not shown) therebetween.

As illustrated in FIGS. 2A and 2B, the compressor 200 may include a balance piston seal assembly 238 having a balance piston seal 240 disposed about the balance piston 232 and configured to prevent or reduce a flow of the process fluid from leaking or flowing past the balance piston 232. For example, as illustrated in FIG. 2B, the balance piston seal 240 may be disposed radially outward from an outer radial surface 242 of the balance piston 232. In at least one embodiment, illustrated in FIG. 2A, the balance piston seal 240 may be or include a single, annular monolithic body. In another embodiment, the balance piston seal 240 may be formed from one or more arcuate segments configured to be coupled with one another. The balance piston seal 240 may be fabricated from one or more metals (e.g., a metal alloy). The balance piston seal 240 may be rotationally stationary with respect to the rotary shaft 108 and the balance piston 232 coupled therewith, which may rotate relative to the balance piston seal 240. An inner radial surface 244 of the balance piston seal 240 may extend circumferentially about and be radially offset from the outer radial surface 242 of the balance piston 232. The inner radial surface 244 of the balance piston seal 240 and the outer radial surface 242 of the balance piston 232 may at least partially define a radial gap or clearance 246 therebetween.

The inner radial surface 244 of the balance piston seal 240 may be or may provide a seal surface for the balance piston seal 240. It should be appreciated that the inner radial surface 244 may define any type of seal known in the art. For example, the inner radial surface 244 of the balance piston seal 240 may define a plurality of teeth (not shown) extending radially inward toward the outer radial surface 242 of the balance piston 232. Accordingly, the balance piston seal 240 may have a labyrinth seal along the inner radial surface 244 thereof. In another example, the inner radial surface 244 of the balance piston seal 240 may define a plurality of holes or openings (not shown). Accordingly, the balance piston seal 240 may provide a hole pattern sealing surface or a damper-type seal surface along the inner radial surface 244 thereof. In yet another example, the inner radial surface 244 may define a plurality of generally hexagonally-shaped openings (not shown) to thereby provide the balance piston seal 240 with a honeycomb seal surface along the inner radial surface 244 thereof.

The balance piston seal 240 may be coupled with (e.g., indirectly or directly) the casing 202. In at least one embodiment, the balance piston seal 240 may be directly coupled with the casing 202. In another embodiment, the balance piston seal 240 may be indirectly coupled with the casing 202 via a stationary support 248 of the balance piston seal assembly 238. The balance piston seal 240 may generally be stationary with respect to the rotary shaft 108 and the balance piston 232 coupled therewith, which may rotate relative to the balance piston seal 240. In at least one example, the balance piston seal 240 may be coupled with the stationary support 248 and/or the casing 202 via one or more mechanical fasteners (one is shown 250). Illustrative mechanical fasteners may include, but are not limited to, one or more bolts, studs and nuts, or any other mechanical fasteners known in the art. In another example, the balance piston seal 240 may be coupled with the stationary support 248 via an interference or resistance fit or interlocking connections. In at least one embodiment, the stationary support 248 may be coupled with the casing 202. In another embodiment, the stationary support 248 may form a portion of or be integral with the casing 202 of the compressor 200.

Figure 3:
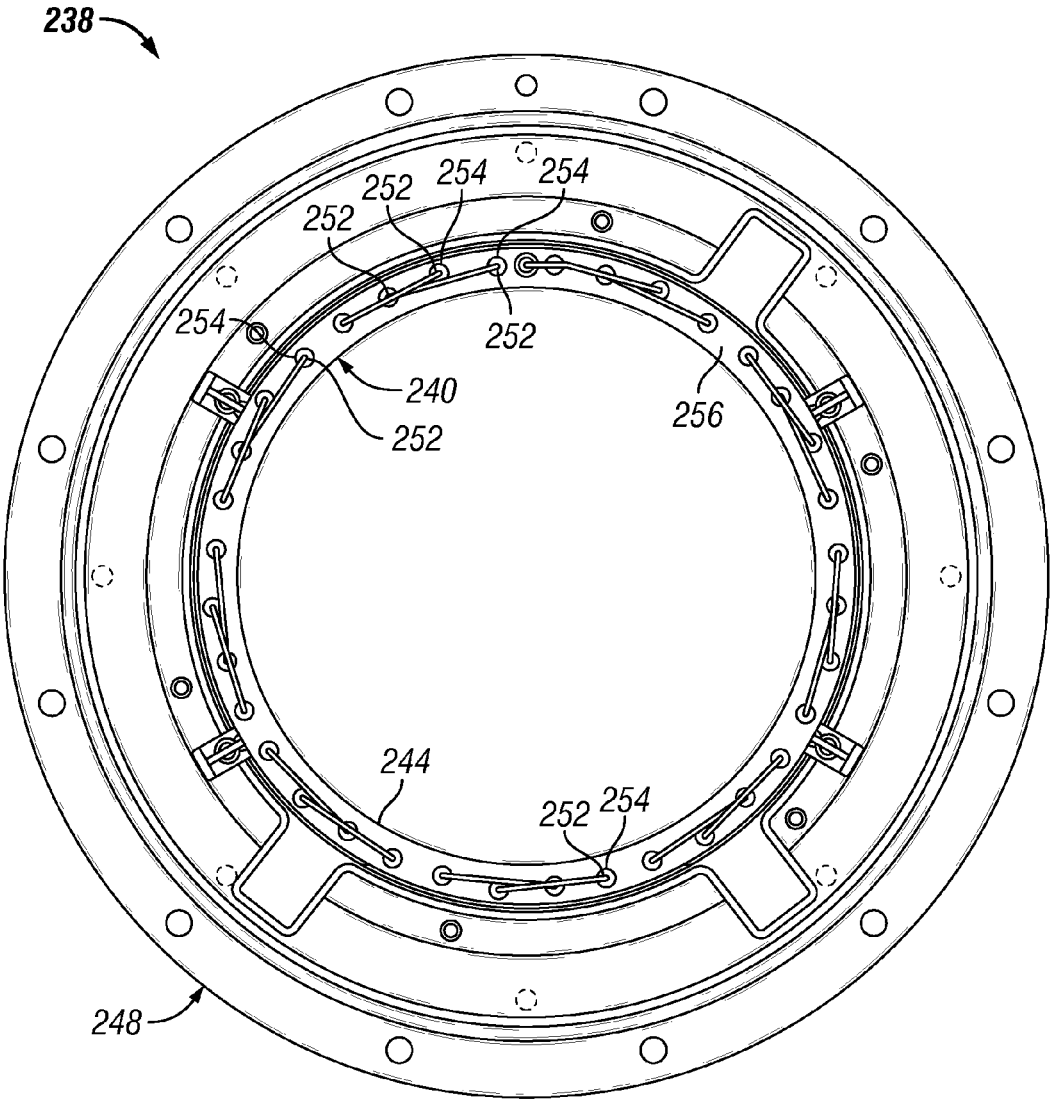
FIG. 3 illustrates a detailed, plan view of the balance piston seal assembly of FIG. 2B including the balance piston seal and the stationary support, according to one or more embodiments disclosed.

FIG. 3 illustrates a detailed, plan view of the balance piston seal assembly 238 of FIG. 2B including the balance piston seal 240 and the stationary support 248, according to one or more embodiments. As illustrated in FIG. 2B and further illustrated in detail in FIG. 3, the balance piston seal assembly 238 may include a plurality of heaters or heating elements (one is shown 252 in FIG. 2B) in thermal communication with the balance piston seal 240. For example, the balance piston seal 240 may define one or more blind holes or bores (one is shown 254 in FIG. 2B) at least partially extending therethrough and configured to receive the respective heating elements 252. As further illustrated in FIG. 2B, the bore 254 may at least partially extend from a first axial end surface 256 toward a second axial end surface 258 of the balance piston seal 240. Each of the heating elements 252 may be or include a resistance heater configured to receive electrical power and generate heat. For example, each of the heating elements 252 may include a generally helical heating coil configured to receive the electrical power and generate heat.

In an exemplary embodiment, illustrated in FIG. 3, any two or more of the heating elements 252 may be coupled with one another. For example, a plurality of the heating elements 252 may be coupled with one another in series. In another example, a plurality of the heating elements 252 may be coupled with one another in parallel. The bores 254 and the respective heating elements 252 disposed therein may be circumferentially spaced about the balance piston seal 240. For example, the bores 254 and the respective heating elements 252 disposed therein may be circumferentially spaced at substantially equal intervals along the first axial end surface 256 of the balance piston seal 240. Accordingly, the heating elements 252 may be configured to evenly or uniformly heat the balance piston seal 240. In another example, the bores 254 and the respective heating elements 252 disposed therein may be circumferentially spaced at varying intervals along the first axial end surface 256 of the balance piston seal 240.

The heating elements 252 of the balance piston seal assembly 238 may be configured to control a radial length of the radial clearance 246. For example, the heating elements 252 may be configured to heat the balance piston seal 240 to a temperature sufficient to cause thermal expansion of the balance piston seal 240 and thereby increase the radial length of the radial clearance 246. As further described herein, during one or more modes of operation, the heating elements 252 may heat the balance piston seal 240 to increase the radial length of the radial clearance 246 and prevent damage to the impeller 222, the balance piston 232, and/or the balance piston seal 240. The one or more modes of operation may include, but are not limited to, a start-up mode, a shut-down mode, a synchronization mode, a failure event mode, a load control mode, a normal operation mode, a steady state mode, or the like, or any combination thereof.

In an exemplary operation of the compressor 200, with continued reference to FIGS. 2A, 2B, and 3, the driver 104 (see FIG. 1) may drive the compressor 200 from rest to the steady state mode of operation by accelerating or rotating the rotary shaft 108 (via the drive shaft 106), the impeller 222, and the balance piston 232 coupled therewith. The impeller 222 and the balance piston 232 may rotate relative to the balance piston seal 240 and about the longitudinal axis 228. The acceleration and/or rotation of the impeller 222 may draw the process fluid into the compressor 200 via the inlet passageway 206. The inlet guide vanes 216 disposed in the inlet passageway 206 may induce one or more flow properties (e.g., swirl) to the process fluid flowing therethrough. The rotation of the impeller 222 may further draw the process fluid from the inlet passageway 206 to and through the rotating impeller 222, and urge the process fluid to the tip 230 of the impeller 222, thereby increasing the velocity (e.g., kinetic energy) thereof. The process fluid from the impeller 222 may be discharged from the tip 230 thereof and directed to the diffuser 210 fluidly coupled therewith. The diffuser 210 may receive the process fluid from the impeller 222 and convert the velocity (e.g., kinetic energy) of the process fluid from the impeller 222 to potential energy (e.g., increased static pressure). The diffuser 210 may direct the process fluid downstream to the volute 212 fluidly coupled therewith. The volute 212 may collect the process fluid and deliver the process fluid to one or more downstream pipes and/or process components (not shown). The volute 212 may also be configured to increase the static pressure of the process fluid flowing therethrough by converting the kinetic energy of the process fluid to increased static pressure.

During the start-up mode of operation (e.g., cold transient start-up), the impeller 222 and the balance piston 232 coupled therewith may expand or grow radially outward toward the balance piston seal 240. For example, centrifugal forces generated from the rotation of the rotary shaft 108 may act on the impeller 222 and the balance piston 232 to thereby cause the radially outward expansion of the impeller 222 and the balance piston 232. Thermal energy or heat generated in the compressor 200 may also at least partially cause the radially outward expansion of the impeller 222 and the balance piston 232. For example, compressing the process fluid in the compressor 200 may generate heat (e.g., heat of compression) near or proximal the impeller 222 (e.g., the tip 230 of the impeller 222) and/or the balance piston 232. The heat generated may be at least partially absorbed by the impeller 222 and the balance piston 232, thereby resulting in the thermal expansion and radial growth of the impeller 222 and the balance piston 232. The radial expansion or growth of the impeller 222 and the balance piston 232 toward the balance piston seal 240 may reduce or eliminate the radial clearance 246. The reduction or elimination of the radial clearance 246 may cause incidental contact between the outer radial surface 242 of the balance piston 232 and the inner radial surface 244 of the balance piston seal 240, thereby resulting in damage to the balance piston 232 and/or the balance piston seal 240.

During one or more modes of operation, the heating elements 252 may heat the balance piston seal 240 to a temperature sufficient to thermally expand the balance piston seal 240 and increase the radial length of the radial clearance 246. For example, prior to and/or during the start-up mode of operation, the heating elements 252 may heat the balance piston seal 240 to thermally expand the balance piston seal 240 and increase the radial length of the radial clearance 246, thereby preventing damage from the incidental contact between the balance piston 232 and the balance piston seal 240. As the impeller 222 and the balance piston 232 rotate or accelerate to a design speed to achieve the steady state mode of operation, power to the heating elements 252 may be regulated to thereby control the thermal expansion of the balance piston seal 240. It should be appreciated that the ability to thermally treat the balance piston seal 240 with the heating elements 252 may reduce a minimum radial length of the radial clearance 246. For example, the heating elements 252 may thermally treat or expand the balance piston seal 240 to accommodate or ensure sufficient clearance for the expansion (e.g., thermal and/or centrifugal expansion) of the impeller 222 and the balance piston 232 during one or more modes (e.g., cold transient start-up mode) of operating the compressor 200. It should further be appreciated that the ability to thermally treat the balance piston seal 240 may reduce parasitic losses and/or improve rotordynamic stability during the one or more modes of operation.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

We claim:

1. A balance piston seal assembly for a balance piston of a compressor, comprising:

a balance piston seal configured to be disposed about the balance piston such that an inner radial surface of the balance piston seal and an outer radial surface of the balance piston define a radial clearance therebetween; and a plurality of heaters in thermal communication with the balance piston seal and configured to heat and thermally expand the balance piston seal and thereby increase a radial length of the radial clearance, wherein the balance piston seal defines a plurality of bores at least partially extending therethrough from a first axial end surface toward a second axial end surface thereof, wherein each heater of the plurality of heaters is disposed in a respective bore of the plurality of bores.

2. The balance piston seal assembly of claim 1, wherein the plurality of bores and the respective heaters disposed therein are circumferentially spaced about the balance piston seal at substantially equal intervals.

3. The balance piston seal assembly of claim 1, wherein the plurality of bores and the respective heaters disposed therein are circumferentially spaced about the balance piston seal at varying intervals.

4. A balance piston seal assembly piston of a compressor, comprising:

a balance piston seal configured to be disposed about the balance piston such that an inner radial surface of the balance piston seal and an outer radial surface of the balance piston define a radial clearance therebetween; and a plurality of heaters in thermal communication with the balance piston seal and configured to heat and thermally expand the balance piston seal and thereby increase a radial length of the radial clearance, wherein each heater of the plurality of heaters comprises a helical heating coil configured to receive electrical power and generate heat.

5. A balance piston seal assembly for a balance piston of a compressor, comprising:

a balance piston seal configured to be disposed about the balance piston such that an inner radial surface of the balance piston seal and an outer radial surface of the balance piston define a radial clearance therebetween; and a plurality of heaters in thermal communication with the balance piston seal and configured to heat and thermally expand the balance piston seal and thereby increase a radial length of the radial clearance, wherein the plurality of heaters are coupled with one another in series.

6. A balance piston seal assembly for a balance piston of a compressor, comprising:

a balance piston seal configured to be disposed about the balance piston such that an inner radial surface of the balance piston seal and an outer radial surface of the balance piston define a radial clearance therebetween; and a plurality of heaters in thermal communication with the balance piston seal and configured to heat and thermally expand the balance piston seal and thereby increase a radial length of the radial clearance, wherein the plurality of heaters are coupled with one another in parallel.

7. A compressor, comprising:

a casing;

a rotary shaft disposed in the casing and configured to be driven by a driver;

an impeller coupled with and configured to be driven by the rotary shaft;

a balance piston integral with the impeller and configured to balance an axial thrust generated by the impeller;

a balance piston seal disposed about the balance piston such that an inner radial surface of the balance piston seal and an outer radial surface of the balance piston define a radial clearance therebetween; and a plurality of heaters in thermal communication with the balance piston seal and configured to heat and thermally expand the balance piston seal and thereby increase a radial length of the radial clearance, wherein the balance piston seal defines a plurality of bores at least partially extending therethrough from a first axial end surface toward a second axial end surface thereof, wherein each heater of the plurality of heaters is disposed in a respective bore of the plurality of bores.

8. The compressor of claim 7, further comprising an axial inlet coupled or integral with the casing.

9. The compressor of claim 8, wherein the axial inlet and the casing at least partially define a fluid pathway of the compressor, the fluid pathway comprising:

an inlet passageway configured to receive a process fluid comprising carbon dioxide;

an impeller cavity fluidly coupled with the inlet passageway and configured to receive the impeller;

a diffuser fluidly coupled with the impeller cavity; and a volute fluidly coupled with the diffuser.

10. The compressor of claim 9, wherein the impeller is configured to receive the process fluid from the inlet passageway and discharge the process fluid to the diffuser at an absolute Mach number of about one or greater.

11. The compressor of claim 10, wherein the compressor is configured to provide a compression ratio of at least about 10.1.

12. The compressor of claim 7, wherein the plurality of bores and the respective heaters disposed therein are circumferentially spaced about the balance piston seal at substantially equal intervals.

13. A compression system, comprising:

a diver; and a compressor couple with and configured to be driven by the driver, the compressor comprising:

a casing;

an inlet coupled or integral with the casing, the inlet and the casing at least partially defining a fluid pathway of the compressor, the fluid pathway configured to receive a process fluid;

a rotary shaft disposed in the casing configured to couple compressor with the driver;

an impeller coupled with and configured to be rotated by the driver via the rotary shaft;

a balance piston integral with the impeller and configured to balance an axial thrust generated by the rotation of the impeller;

a balance piston seal disposed radially outward of the balance piston such that the balance piston seal and the balance piston define a radial clearance therebetween; and a plurality of heaters in thermal communication with the balance piston seal and configured to heat and thermally expand the balance piston seal and thereby increase a radial length of the radial clearance, wherein the balance piston seal defines a plurality of bores circumferentially spaced about the balance piston seal at substantially equal intervals, and each heater of the plurality of heaters is disposed in a respective bore of the plurality of bores.

14. The compression system of claim 13, wherein the impeller is configured to discharge the process fluid to the diffuser at an absolute Mach number of about one or greater.

15. The compression system of claim 13, wherein the compressor is configured to provide a compression ratio of at least about 10:1.

* * * * *